US012560378B2

(12) United States Patent
Kusakci et al.

(10) Patent No.: US 12,560,378 B2
(45) Date of Patent: Feb. 24, 2026

(54) COOLING DEVICE HAVING A CARRIER TRAY FOR A CONTROL UNIT

(71) Applicant: BSH Hausgeräte GmbH, Munich (DE)

(72) Inventors: Zeki Demirhan Kusakci, Tekirdag (TR); Ashish Modi, Istanbul (TR)

(73) Assignee: BSH Hausgeräte GmbH, Munich (DE)

( * ) Notice: Subject to any disclaimer, the term of this patent is extended or adjusted under 35 U.S.C. 154(b) by 276 days.

(21) Appl. No.: 18/088,918

(22) Filed: Dec. 27, 2022

(65) Prior Publication Data

US 2023/0204283 A1 Jun. 29, 2023

(51) Int. Cl.
*F25D 29/00* (2006.01)

(52) U.S. Cl.
CPC ..... *F25D 29/005* (2013.01)

(58) Field of Classification Search
CPC ..... F25D 29/005
See application file for complete search history.

(56) References Cited

U.S. PATENT DOCUMENTS

2006/0077486 A1* 4/2006 Manrique Lizarraga ..... B41J 29/02 358/1.15

FOREIGN PATENT DOCUMENTS

KR 20210112188 A 9/2021
WO 2022220374 A1 10/2022

* cited by examiner

*Primary Examiner* — Nael N Babaa
(74) *Attorney, Agent, or Firm* — Laurence A. Greenberg; Werner H. Stemer; Ralph E. Locher

(57) ABSTRACT

A cooling device has a body defining a storage space and at least one control unit for controlling an operation of the cooling device, and provided on an outer wall surface of the body facing outside. The cooling device further contains at least one carrier tray whereon the control unit is positioned, and wherein the carrier tray is configured to be movable between a closed position in which the carrier tray is positioned on the outer wall surface, and an open position in which the carrier tray at least partially extends outwardly from the body.

11 Claims, 5 Drawing Sheets

COOLING DEVICE HAVING A CARRIER TRAY FOR A CONTROL UNIT

CROSS-REFERENCE TO RELATED APPLICATION

This application claims the priority, under 35 U.S.C. § 119, of Turkish Patent Application TR 2021/021325, filed Dec. 28, 2021; the prior application is herewith incorporated by reference in its entirety.

FIELD AND BACKGROUND OF THE INVENTION

The present invention relates to a cooling device according to the preamble of the independent claim.

A cooling device is an electronic device which provides keeping of food without spoiling for a specific duration and which cools beverages and which has a chamber which is at least partially closed. Cooling devices operate by means of a cooling cycle. In general, a cooling cycle takes place in a cooler, and the changes, formed by suctioning of heat by a cooling fluid and afterwards emitting heat by the cooling fluid, are defined in a cooling cycle. In a cooling cycle, the low-pressure cooling fluid is increased to high pressure by the compressor and is transferred to condenser. Condensation takes place in the condenser, and transformation into low pressure liquid is realized by passing through the expansion valve, and from here, cooling is realized by means of the evaporator.

There are pluralities of units in the cooling cycle. Additionally, there are electronic elements like sensors, illumination elements on the cooling device. These electronic elements must be associated and controlled with a control unit. The control unit can be placed in parts like base, ceiling and side wall on the cooling devices.

The application with number KR19980050656U known in the literature relates to a micro-PCB fixing device for a refrigerator, and is not coupled and fixed by fixing screws as used in the prior art, but guides formed on both sides of the PCB base and guide grooves formed on the inner lower part of the PCB cover are engaged. By making the structure to be coupled by sliding, it is easy to disassemble and assemble to reduce manufacturing and repair time, and it is possible to save materials by not using a set screw, thereby improving overall productivity.

As a result, because of the abovementioned problems, an improvement is required in the related technical field.

The present invention relates to a container arrangement, for eliminating the abovementioned disadvantages and for bringing new advantages to the related technical field.

SUMMARY OF THE INVENTION

An object of the present invention is to provide a movable carrier tray whereon the control unit is positioned in cooling devices.

Another object of the present invention is to provide a container arrangement for facilitating servicing intervention in cooling devices.

In order to realize the abovementioned objects and the objects which are to be deducted from the detailed description below, the present invention is a cooling device containing a body defining a storage space and at least one control unit for controlling an operation of the cooling device, provided on an outer wall surface of the body facing outside. Accordingly, the cooling device further comprises at least one carrier tray whereon the control unit is positioned, and wherein the carrier tray is configured to be movable between a closed position in which the carrier tray is positioned on the outer wall surface, and an open position in which the carrier tray at least partially extends outwardly from the body. Thus, a cooling device is obtained which has a container arrangement with improved servicing and assembly services.

In another possible embodiment of the present invention, at least one control unit housing, fixedly positioned on the body, configured so that it at least partially surrounds the carrier tray in the closed position. Thus, the control unit on the carrier tray is protected from external factors in the closed position.

In another possible embodiment of the present invention, the control unit housing contains an inner gap for at least partially receiving the carrier tray. Thus, the carrier tray is at least partially surrounds in the closed position.

In another possible embodiment of the present invention, at least one first connection element is provided on the control unit housing, and wherein at least one second connection element is provided on the carrier tray so as to be attached to the corresponding first connection element. Thus, the carrier tray can be displaced between the open position and the closed position relative to the control unit housing.

In another possible embodiment of the present invention, the first connection element is being a guide opening and wherein the second connection element is being a connection protrusion associated with the guide opening. Thus, the second connection element is connected with the first connection element, allowing the carrier tray to be displaced relative to the control unit housing.

In another possible embodiment of the present invention, the first connection element is being an essentially L-shaped guide opening. Thus, sliding displacement of the second connection element in the opening of the first connection element is provided.

In another possible embodiment of the present invention, the first connection element has a first guiding portion extending longitudinally and a second guiding portion extending in a direction perpendicular to the first guiding portion at an end of the first guiding portion. Thus, sliding of the second connection element in the first guiding portion and locking in the second guiding portion are provided.

In another possible embodiment of the present invention, the second guiding portion is configured so that the carrier tray is being in a rest position in which an angle is provided between the carrier tray and the outer wall surface. Thus, the second connection element is locked in the second guiding portion.

In another possible embodiment of the present invention, at least one first lock element is provided on the control unit housing, wherein at least one second lock element is provided on the carrier tray, and wherein the lock elements are arranged to be attached to each other, when the carrier tray is in the closed position. Thus, the carrier tray is prevented from moving to the open position by mistake.

In another possible embodiment of the present invention, the carrier tray contains at least one handle portion provided at a front wall which is in a perpendicular plane with respect to the outer wall surface of the body. Thus, the user is provided to move the carrier tray by holding it.

Other features which are considered as characteristic for the invention are set forth in the appended claims.

Although the invention is illustrated and described herein as embodied in a carrier tray for a control unit of a cooling device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

In this detailed description, the subject matter is explained with references to examples without forming any restrictive effect only in order to make the subject more understandable.

Figure 1:
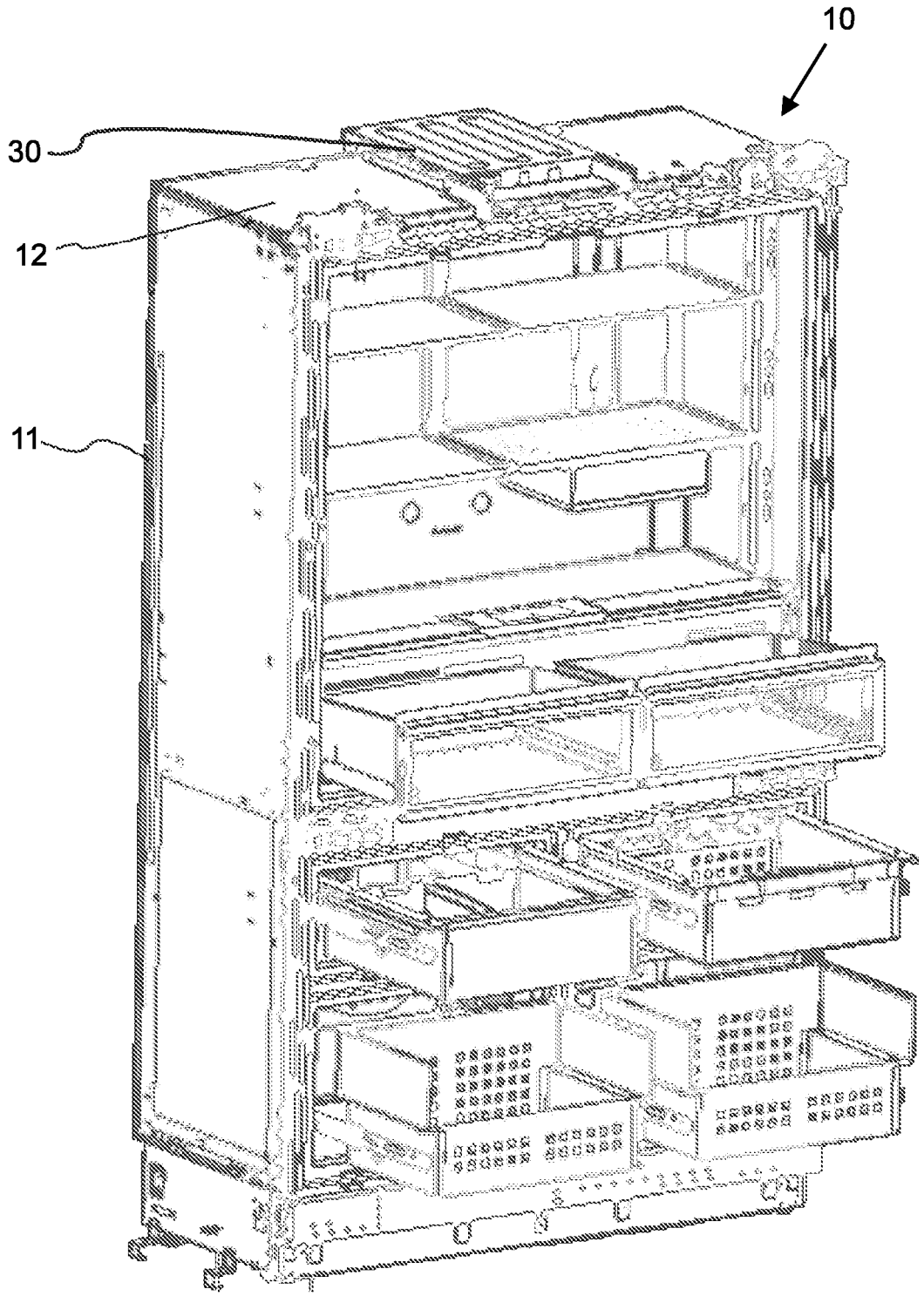
FIG. 1 is a diagrammatic, perspective view of a subject-matter cooling device according to the invention.

Referring now to the figures of the drawings in detail and first, particularly to FIG. 1 thereof, there is shown a cooling device 10. In the subject-matter cooling device 10, items placed in at least one body 11 are cooled by means of a cooling cycle. The aim of realizing cooling in the cooling device 10 is to keep various items under environmental temperature in said body 11. The cooling cycle of the cooling device 10 is controlled by means of at least one control unit 20. The control unit 20 is essentially a PCB. Thus, the control unit 20 controls operation of various components provided on the cooling device 10. The control unit 20 on the cooling device 10 is located on an outer wall surface 12 of the body 11. The outer wall surface 12 is essentially a ceiling part of the body 11 away from the floor.

Figure 2:
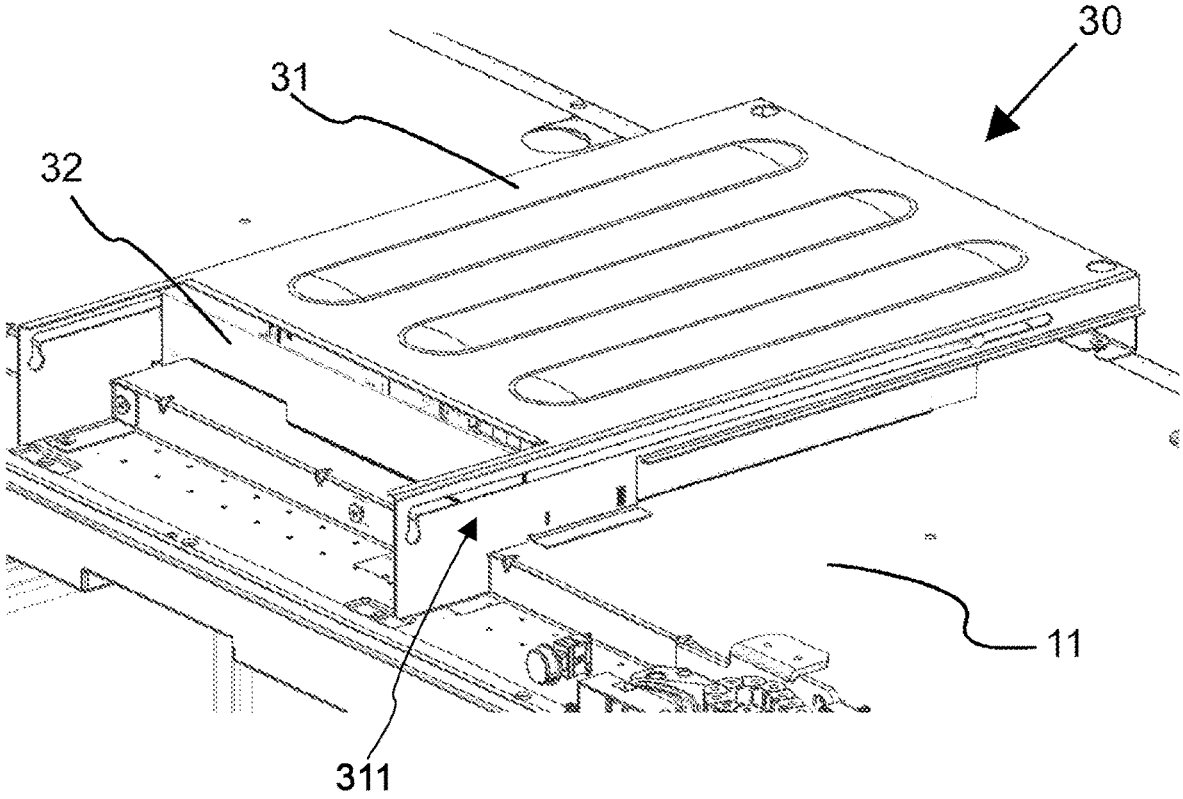
FIG. 2 is a perspective view of a container arrangement provided on the subject-matter cooling device.

In FIG. 2, a representative perspective view of at least one container arrangement 30 positioned on the subject matter cooling device 10 is given. Accordingly, the container arrangement 30 is positioned on the body 11. The container arrangement 30 control unit houses at least one part of the control unit 20 and protects the control unit 20 from external factors. In order to be able to realize this, the container arrangement 30 has at least one control unit housing 31 and at least one carrier tray 32. The carrier tray 32 is in the form of a drawer. The control unit housing 31 is in the form of a chamber connected in a fixed manner on the cooling device 10 and wherein the carrier tray 32 can be positioned. The control unit 20 is positioned on the carrier tray 32. Thus, assembly and maintenance facility is provided to the control unit 20 as the carrier tray 32 is placed into and moved away the control unit housing 31.

Figure 3:
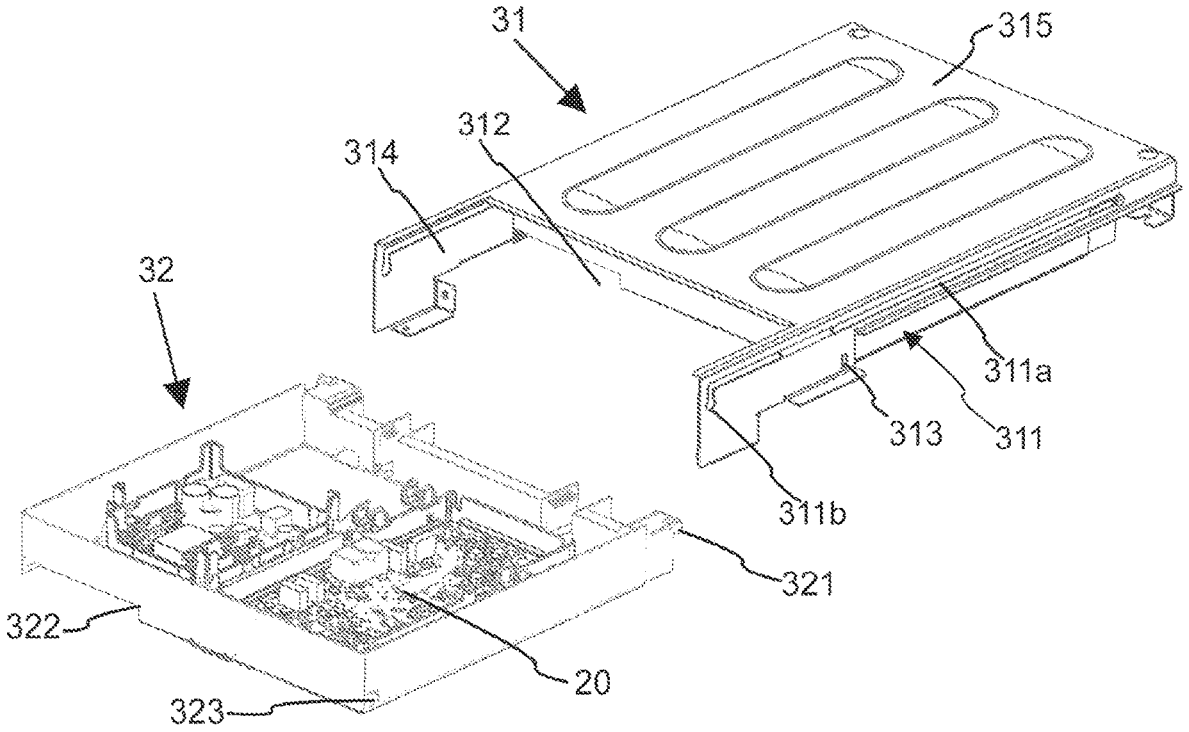
FIG. 3 is an exploded view of the container arrangement provided on the subject-matter cooling device.

In FIG. 3, a representative dismantled view of the container arrangement 30 provided on the subject-matter cooling device 10 is given. There is at least one inner gap 312 for the placement of the carrier tray 32 on the control unit housing 31. The inner gap 312 at least partially receives the carrier tray 32. A vertical part 314 and an upper wall 315 are provided on at least one side of the inner gap 312 on the control unit housing 31. The vertical part 314 essentially exists on both mutual sides of the inner gap 312. The carrier tray 32 can be placed to the inner gap 312. The placement of the carrier tray 32 to the inner gap 312 provided on the control unit housing 31 is a closed position II. The control unit housing 31, fixedly positioned on the body 11, is configured so that it at least partially surrounds the carrier tray 32 in the closed position II. The extending of the carrier tray 32 outwardly from a front wall 13 of the body 11 is at least one open position I. The front wall 13 is the side of the body 11 which faces the user under normal usage conditions of the cooling device 10. As the carrier tray 32 is moved between the closed position II and the open position I, maintenance and assembly can be realized for the container arrangement 30.

The control unit housing 31 contains at least one first connection element 311. The carrier tray 32 comprises at least one second connection element 321. The first connection element 311 and the second connection element 321 are configured to be associated with each other. In a possible embodiment of the present invention, the first connection element 311 is a guide opening. The second connection element 321 can be in the form of a pin formed in a manner able to enter into the guide opening. The first connection element 311, provided in the form of a guide opening, exists mutually on the vertical parts 314 of the control unit housing 31. Thus, as the second connection element 321 is slid on the first connection element 311, the container arrangement 30 can displace between the open position I and the closed position II. The first connection element is 311 being an essentially L-shaped guide opening. Thus, sliding displacement of the second connection element 321 in the opening of the first connection element 311 is provided. The first connection element 311 has a first guiding portion 311*a* extending longitudinally and a second guiding portion 311*b* extending in a direction perpendicular to the first guiding portion 311*a* at an end of the first guiding portion 311*a*. Thus, sliding of the second connection element 321 in the first guiding portion 311*a* and locking in the second guiding portion 311*b* are provided. However, in alternative embodiments, the cooling device 10 can be produced also in different shapes in order to displace between the open position I and the closed position II.

Figure 4:
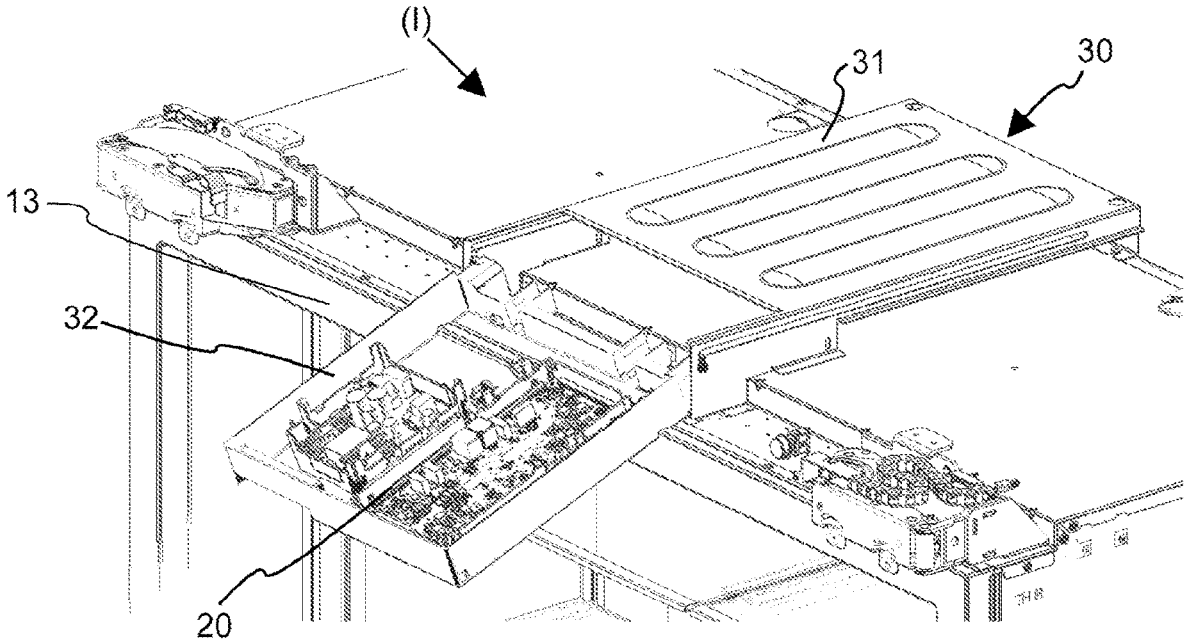
FIG. 4 is a perspective view of the container arrangement provided on the subject-matter cooling device where the container arrangement is in an open position.

In FIG. 4, a representative perspective view of the container arrangement 30 provided on the subject-matter cooling device 10 is given where the container arrangement 30 is in the open position I. While the container arrangement 30 is in the open position I, it is positioned in a manner facing outwardly from the front wall 13 such that servicing process can be applied to the control unit 20. In the container arrangement 30, there is at least one second guiding portion 311*b* for keeping the carrier tray 32 in the open position I with respect to the control unit housing 31. The second guiding portion 311*b* keeps the carrier tray 32 continuously in the open position I. Therefore, second guiding portion 311*b* is configured to prevent essentially the movement of the second connection element 321 on the first connection element 311. In case the first connection element 311 is provided in a guide opening form, the second guiding portion 311*b* is provided in the form of a pocket which is adjacent to the guide opening. In case the second connection element 321 is slid on the first connection element 311 and passes to the open position I, the second connection element 321 is stopped by the second guiding portion 311*b* and movement of the second connection element 321 in the guide opening is prevented. In the invention, the second guiding portion 311*b* is configured so that the carrier tray 32 is being in a rest position in which an angle is provided between the carrier tray 32 and the outer wall surface 12. Thus, the undesired movement of the carrier tray 32 in the servicing process is prevented.

Figure 5:
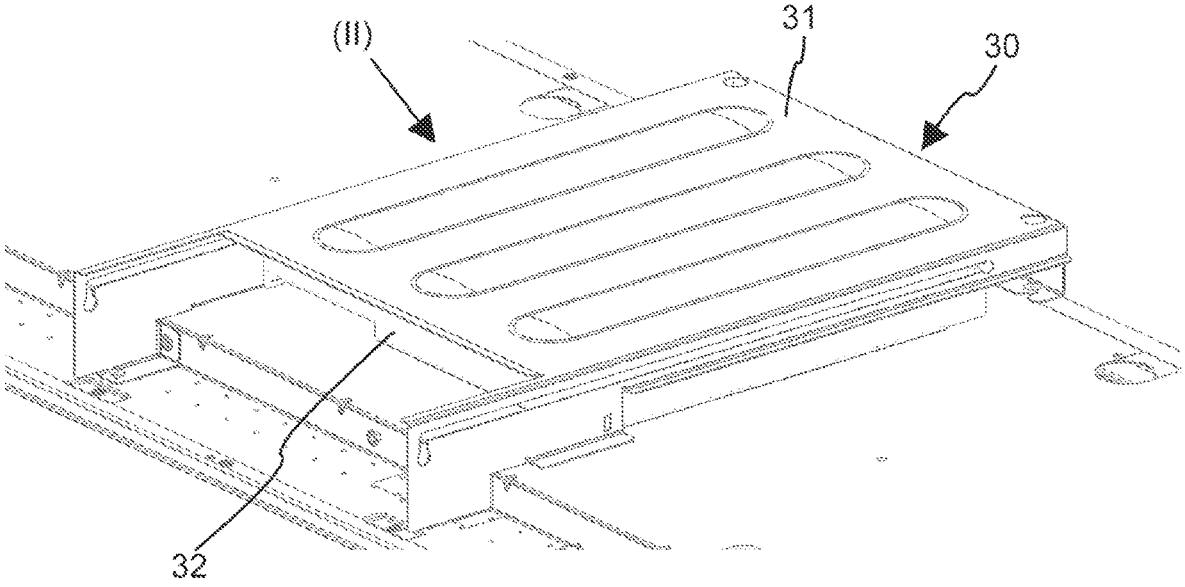
FIG. 5 is a perspective view of the container arrangement provided on the subject-matter cooling device where the container arrangement is in a closed position.

In FIG. 5, a representative perspective view of the container arrangement 30 provided on the subject-matter cooling device 10 is given where the container arrangement 30 is in the closed position II. Accordingly, the carrier tray 32 passes to the closed position II as it fills the inner gap 312 of the control unit housing 31. This closed position II is the operation position of the cooling device 10 under normal conditions, and the control unit 20 is protected from external factors. For providing this, the second connection element 321 moves on the first connection element 311 and fills the inner gap 312. In order to be able to keep the carrier tray 32 in the closed position II, at least one first lock element 313 is positioned on the control unit housing 31, and at least one second lock element 323 is positioned on the carrier tray 32. The first lock element 313 and the second lock element 323 are associated with each other in the closed position II, and delimit the movement of the carrier tray 32. For this reason, in a possible embodiment of the present invention, the first lock element 313 is a hole form provided on the carrier tray 32. The second lock element 323 is a protrusion formed in a manner placed to the first lock element 313 which is in hole form. Thus, the desired locking can be realized at the closed position II.

At least one handle portion 322 is positioned on the carrier tray 32. The handle portion 322 is essentially held by the user, and enables displacement of the carrier tray 32 between the open position I and the closed position II. By means of this, the reachability of the container arrangement 30 is increased. In a possible embodiment, the handle portion 322 is provided at a front wall which is in a perpendicular plane with respect to the outer wall surface 12 of the body 11.

By means of all these embodiments, the requirement of operation at the top part of the cooling device 10 for servicing is eliminated. The assembly of the control unit 20 onto the cooling device 10 can be facilitated by means of the container arrangement 30, and repair and maintenance services in case of failures are facilitated. Additionally, as the control unit 20 is positioned on the outer wall surface 12 of the cooling device 10, the wetness risks are also prevented.

The protection scope of the present invention is set forth in the annexed claims and cannot be restricted to the illustrative disclosures given above, under the detailed description. It is because a person skilled in the relevant art can obviously produce similar embodiments under the light of the foregoing disclosures, without departing from the main principles of the present invention.

The following is a summary list of reference numerals and the corresponding structure used in the above description of the invention.

REFERENCE LIST

10 Cooling device
11 Body
12 Outer wall surface
13 Front wall
20 Control unit
30 Container arrangement
31 Control unit housing
311 First connection element
311*a* First guiding portion
311*b* Second guiding portion
31 Inner gap
313 First lock element
314 Vertical part
315 Upper wall
32 Carrier tray
321 Second connection element
322 Handle portion
323 Second lock element
I Open position
II Closed position

The invention claimed is:

1. A cooling device, comprising:

a body defining a storage space and having an outer wall surface;

at least one controller for controlling an operation of the cooling device, and disposed on said outer wall surface of said body facing outside; and at least one carrier tray whereon said at least one controller is positioned, wherein said at least one carrier tray is configured to be movable between a closed position in which said at least one carrier tray is positioned on said outer wall surface, and an open position in which said at least one carrier tray is held on said body and at least partially extends outwardly from said body tilted relative to said outer wall surface.

2. The cooling device according to claim 1, further comprising at least one controller housing, fixedly positioned on said body, and configured so that said at least one controller housing at least partially surrounds said at least one carrier tray in the closed position.

3. The cooling device according to claim 2, wherein said at least one controller housing has an inner gap formed therein for at least partially receiving said at least one carrier tray.

4. The cooling device according to claim 2, further comprising:

at least one first connection element disposed on said controller housing; and at least one second connection element disposed on said at least one carrier tray so as to be attached to said at least one first connection element.

5. The cooling device according to claim 4, wherein:

said at least one first connection element is a guide opening; and said at least one second connection element is a connection protrusion associated with said guide opening.

6. A cooling device, comprising:

a body defining a storage space and having an outer wall surface;

at least one controller for controlling an operation of the cooling device, and disposed on said outer wall surface of said body facing outside;

at least one carrier tray whereon said at least one controller is positioned, wherein said at least one carrier tray is configured to be movable between a closed position in which said at least one carrier tray is positioned on said outer wall surface, and an open position in which said at least one carrier tray at least partially extends outwardly from said body;

at least one controller housing, fixedly positioned on said body, and configured so that said at least one controller housing at least partially surrounds said at least one carrier tray in the closed position, said at least one controller housing having an inner gap formed therein for at least partially receiving said at least one carrier tray;

at least one first connection element disposed on said controller housing, said at least one first connection element being an L-shaped guide opening; and at least one second connection element disposed on said at least one carrier tray so as to be attached to said at least one first connection element, said at least one second connection element being a connection protrusion associated with said guide opening.

7. The cooling device according to claim 6, wherein said at least one first connection element has a first guiding portion extending longitudinally and a second guiding portion extending in a direction perpendicular to said first guiding portion at an end of said first guiding portion.

8. The cooling device according to claim 7, wherein said second guiding portion is configured so that said at least one carrier tray is in a rest position in which an angle is provided between said at least one carrier tray and said outer wall surface.

9. The cooling device according to claim 2, further comprising:

at least one first lock element disposed on said controller housing;

at least one second lock element disposed on said at least one carrier tray; and lock elements disposed to be attached to each other, when said at least one carrier tray is in the closed position.

10. The cooling device according to claim 1, wherein said at least one carrier tray has a front wall and at least one handle portion disposed at said front wall which is in a perpendicular plane with respect to said outer wall surface of said body.

11. The cooling device according to claim 6, wherein said at least one second connection element is guided by said L-shaped opening during a displacement of said carrier tray.

* * * * *